US006976310B1

(12) United States Patent
Sim

(10) Patent No.: US 6,976,310 B1
(45) Date of Patent: Dec. 20, 2005

(54) NAIL CLIPPER INSERT

(76) Inventor: Jae K. Sim, 26 Brookstone, Irvine, CA (US) 92604

( * ) Notice: Subject to any disclaimer, the term of this patent is extended or adjusted under 35 U.S.C. 154(b) by 0 days.

(21) Appl. No.: 10/993,027

(22) Filed: Nov. 19, 2004

(51) Int. Cl.[7] ..... A45D 29/02
(52) U.S. Cl. ..... 30/28; 132/75.5
(58) Field of Search ..... 30/26, 27, 28, 30/286, 287; 132/75.5; 28/60

(56) References Cited

U.S. PATENT DOCUMENTS 3,188,737 A * 6/1965 Chase ..... 30/124
3,352,010 A * 11/1967 Keller ..... 30/135
4,196,514 A * 4/1980 Merriman ..... 30/28
4,219,929 A * 9/1980 Min ..... 30/28
4,996,771 A * 3/1991 Williams ..... 30/28
5,010,644 A * 4/1991 Goench ..... 30/28
5,131,146 A * 7/1992 Leininger ..... 30/28
5,564,189 A * 10/1996 Lee ..... 30/28
6,523,545 B2 * 2/2003 Rende ..... 132/75.5

* cited by examiner

*Primary Examiner*—Hwai-Siu Payer
(74) *Attorney, Agent, or Firm*—Stetina Brunda Garred & Brucker

(57) ABSTRACT

Provided is a nail clipper comprising upper and lower clipper arms, a lever arm, a retaining pin and an insert. The upper and lower clipper arms are joined at one end thereof and having cutting edges disposed on an opposite end. The retaining pin extends upwardly through holes formed in the upper and lower clipper arms and is pivotably engaged to the lever arm. Manipulation of the lever arm brings the cutting edges into direct engagement with one another for cutting of an article such as a finger nail. The insert includes an annular shoulder extending upwardly from an upper surface into engagement with the hole in the upper clipper arm. Two pairs of posts extend downwardly from a lower surface of the panel member. The posts are configured to restrict outward projection of clippings during cutting of the article.

17 Claims, 2 Drawing Sheets

NAIL CLIPPER INSERT

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates to nail clipper and, more particularly, to a uniquely configured nail clipper insert specifically adapted to be fitted into a conventional nail clipper and which prevents the outward projection of nail clippings during trimming thereof.

Included in the prior art are several nail clipping devices adapted for manicuring or trimming finger nails and toe nails. Such nail clipping devices typically comprise a pair of metal arm members connected together at one end and spaced apart at an opposing end. A cutting edge is disposed on each of the spaced ends of the arm members. Also typically included with conventional nail clipping devices is a lever arm that is configured to actuate the clipper arms into direct engagement with one another such that the cutting edges can effectively cut or trim a finger nail or toe nail positioned therebetween.

Despite their widespread use, such conventional nail clipping devices possess certain deficiencies which detract from their overall utility. One deficiency of such conventional nail clipper is associated with the inability of such conventional nail clipping devices to retain nail clippings. More specifically, upon trimming or cutting of a finger nail or toenail, a nail clipping is generated which typically scatters or is projected outwardly from the nail clipping device in an unpredictable and unknown trajectory. The inability to retain such nail clippings presents hygiene problems.

In an effort to avoid such hygiene problems, several attempts have been made to prevent the unpredictable and uncontrolled scattering of such nail clippings. For example, the prior art includes several nail clipping devices that are adapted to collect and retain such nail clippings for later disposal. In one such prior art nail clipping device, a triangularly shaped catch basin or reservoir is inserted between the clipper arm members of the nail clipping device. The catch basin is adapted to catch nail clippings after they have been clipped. Unfortunately, the catch basin as described above includes several intricate surface features that are molded thereinto. Such surface features increase the complexity and manufacturing cost of the catch basin. In addition, complexity of the catch basin increases the assembly costs of the nail clipping device.

Another attempt in the prior art to retain nail clippings includes a nail clipping device wherein the catch basin is integrated into the nail clipping device. The integral catch basin includes a door that is hinged so that the door may be outwardly pivoted. Upon clipping or trimming of a finger nail or a toe nail, the nail clippings will purportedly fall into the catch basin for retention until later disposal of the nail clippings. In this regard, a user of the nail clipping device must rotate a lever arm of the nail clipping device out of its operative position such that the user may then open the door and then empty out the nail clippings. The user must then return the door to its closed position followed by rotating the lever arm back to its operative position. Unfortunately, the series of steps required to operate the nail clipping device with integral catch basin reduces its convenience. In addition, the integration of the catch basin with the nail clipping device and the inclusion of the door increases the overall cost of manufacturing of such nail clipping device.

An even further attempt in the prior art to provide a means for catching nail clippings includes a nail clipping device having a hollow sheath or case which may be removably extended over the clipper arm members of a conventional nail clipper. The case is sized and configured to be extended over the nail clipping device from an aft end towards a forward end thereof such that the case encapsulates a major portion of the nail clipper. The case includes a groove formed on an exterior side thereof for receiving the lever arm when such lever arm is returned to its retracted or non-operative position during non-use of the nail clipper device. Unfortunately, the case is relatively large in size and therefore increases the overall volume occupied by the nail clipping device. Such relative large size of the case unfortunately increases the manufacturing, storage and transportation costs of the nail clipping device.

As can be seen, there exists a need in the art for a nail clipper that is configured to minimize or prevent the unpredictable outward projection of nail clippings during cutting thereof by the nail clipper. Furthermore, there exists a need in the art for such a nail clipper which is simple in construction and small in size in order to minimize manufacturing, storage and transportation costs of the nail clipper. Finally, there exists a need in the art for a nail clipper that is convenient to operate.

BRIEF SUMMARY OF THE INVENTION

Provided is an insert adapted to be retrofittable into a nail clipper and which minimizes the outward projection of clippings during trimming of an article such as a finger nail or a toe nail. The nail clipper comprises an upper clipper arm, a lower clipper arm, a lever arm, a retaining pin and the insert. The insert is specifically adapted to be assembled with a conventional nail clipper without additional retrofitting of the nail clipper.

The upper and lower clipper arms of the nail clipper are each configured as an elongate member having opposing ends. One of the ends of each of the upper and lower clipper arms includes a cutting edge formed thereon. The upper clipper arm is joined to the lower clipper arm at the respective ones of the ends opposite that from which the cutting edges are formed in the manner of a conventional nail clipper. The upper and lower clipper arms each include a hole formed adjacent to the cutting edges.

The cutting edges of the upper and lower clipper arms are spaced apart from one another so as to define a gap when the nail clipper is in the non-operative position. The cutting edges may be leveraged toward one another by the lever arm. The retaining pin extends through the lower and upper clipper arms and is configured to be engaged to a groove formed in the retaining pin such that, when placed in the operative position, depressing the lever arm moves the cutting edges axially relative to one another such that the cutting edges come into direct engagement with one another for cutting a finger nail or a toe nail.

The insert is engaged to the hole of the upper clipper arm. The insert includes a panel member having opposing upper and lower surfaces and may be generally rectangularly shaped. The panel member may include opposing panel side edges, a panel forward edge and a panel aft edge. Extending upwardly from the upper surface of the insert is an annular shoulder and is configured to provide a means for connecting the insert to the upper clipper arm.

The annular shoulder may include an upper edge having a radially outwardly protruding lip extending therearound to facilitate engagement of the insert to the upper clipper arm. Extending downwardly from the lower surface may be two pairs of posts which are configured to limit the outward projection of clippings generated during the cutting of finger nails and toe nails. The posts of one of the pairs may be positioned on opposite sides of the annular shoulder adjacent respective ones of the side edges. The posts of the other one of the pairs are preferably positioned adjacent to the panel forward edge.

It is contemplated that the insert may be provided in a variety of sizes sufficient to be complimentary to and retrofittable to a conventional nail clipper of any size. For example, a nail clipper that is used for trimming finger nails is typically of a smaller size than a nail clipper that is used for trimming toe nails and therefore would require a relatively small insert. Conversely, an insert adapted for use with a nail clipper for clipping toe nails is preferably of a proportionally larger size than an insert adapted for use with a nail clipper for clipping finger nails.

BRIEF DESCRIPTION OF THE DRAWINGS

These as well as other features of the present invention will become more apparent upon reference to the drawings wherein.

DETAILED DESCRIPTION OF THE INVENTION

Figure 1:
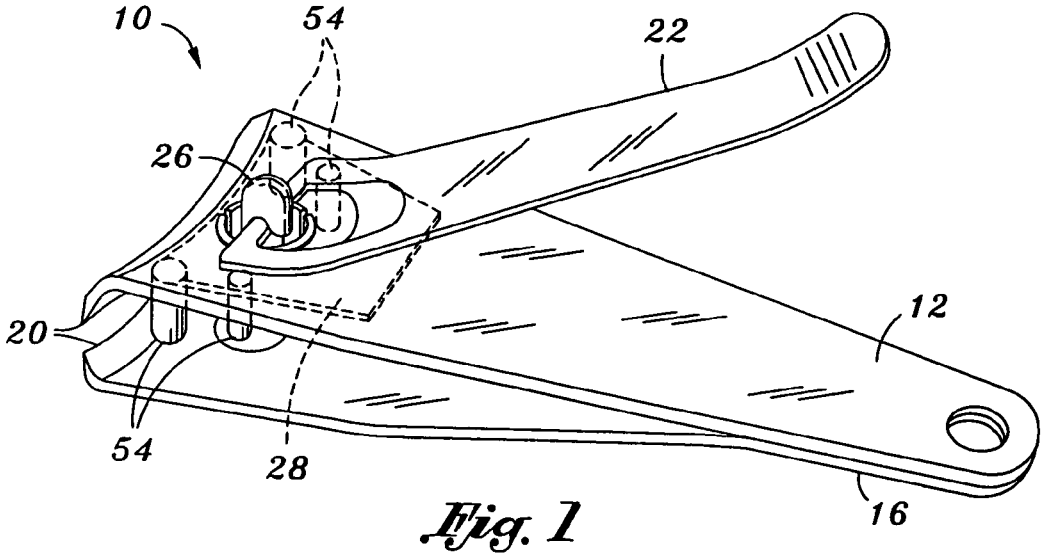
FIG. 1 is a perspective view of conventional nail clipper having an insert installed thereinto and attached to an upper clipper arm of the nail clipper.

Referring now to the drawings wherein the showings are for purposes of illustrating various aspects of the invention and not for purposes of limiting the same, provided is a uniquely configured insert 28 adapted to be retrofittable into a conventional nail clipper 10. The insert 28 is specifically adapted to prevent the outward projection of clippings in an unpredictable trajectory during trimming of an article such as a finger nail or a toe nail. Referring to FIGS. 1–4, shown is the nail clipper 10 which, in its broadest sense, comprises an upper clipper arm 12, a lower clipper arm 16, a lever arm 22, a retaining pin 26 and the insert 28. As will be apparent from the following description, the insert 28 is specifically adapted to be inserted into and/or assembled with a conventional nail clipper 10 without additional retrofitting of the nail clipper 10.

Referring to FIGS. 1–4, shown is the nail clipper 10 which includes the upper clipper arm 12 configured as an elongate member and which has opposing ends. One of the ends includes a cutting edge 20 formed thereon. The lower clipper arm 16 is also configured as an elongate member and also has opposing ends with a cutting edge 20 formed on one of the ends. The upper clipper arm 12 is joined to the lower clipper arm 16 at the respective ones of the ends opposite that from which the cutting edges 20 are formed. The upper clipper arm 12 includes a hole 14 which may be generally oblong or elliptically shaped and which is formed adjacent to the cutting edge 20.

The lower clipper arm 16 also includes a hole 18 which may be a generally circular or round hole formed adjacent the cutting edge 20. As can be seen by reference to FIGS. 1–4, the cutting edges 20 of the upper and lower clipper arms 12, 16 are spaced apart from one another when the upper and lower clipper arms 12, 16 are in the non-operative position. More specifically, the cutting edges 20 are separated by a gap when the upper and lower clipper arms 12, 16 are not engaged to one another but which may be leveraged toward one another by the lever arm 22.

The lever arm 22 has opposing ends and, as can be seen in FIGS. 1–4, is disposed relative to the lower clipper arm 16 such that the upper clipper arm 12 is interposed between the lever arm 22 and the lower clipper arm 16. More specifically, the lever arm 22 is disposed on an outer side of the nail clipper 10 in the arrangement of a conventional nail clipper 10. The retaining pin 26 includes a head which is abutted against an outer side of the lower clipper arm 16 when the retaining pin 26 is extended through the lower and upper clipper arms 16, 12.

More specifically, the retaining pin 26 may be inserted into the circular hole 18 formed in the lower clipper arm 16 and passed upwardly through the elliptically shaped hole 14 in the upper clipper arm 12 to be pivotably engaged to the lever arm 22. As was earlier mentioned, the lever arm 22 includes an aperture 24 formed in a forward end thereof. The retaining pin 26 extends though the aperture 24. The lever arm 22 is configured to be engaged to a groove 56 formed in the retaining pin 26 such that, when placed in the operative position, depressing the lever arm 22 moves the cutting edges 20 axially relative to one another such that the cutting edges 20 come into direct engagement with one another for cutting a finger nail or a toe nail.

Figure 2:
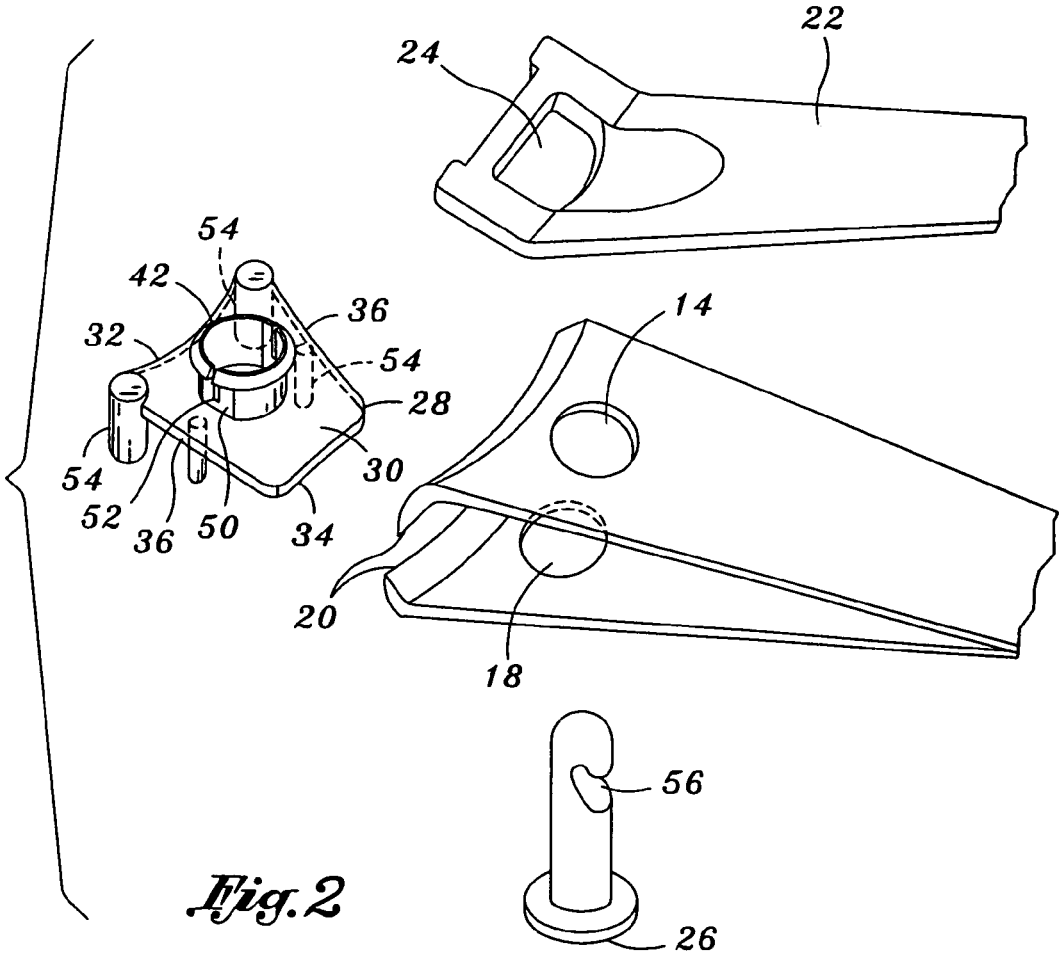
FIG. 2 is an exploded perspective view of the nail clipper and illustrating the interrelationship of the upper clipper arm, a lower clipper arm, a lever arm, a retaining pin and the insert.
Figure 3:
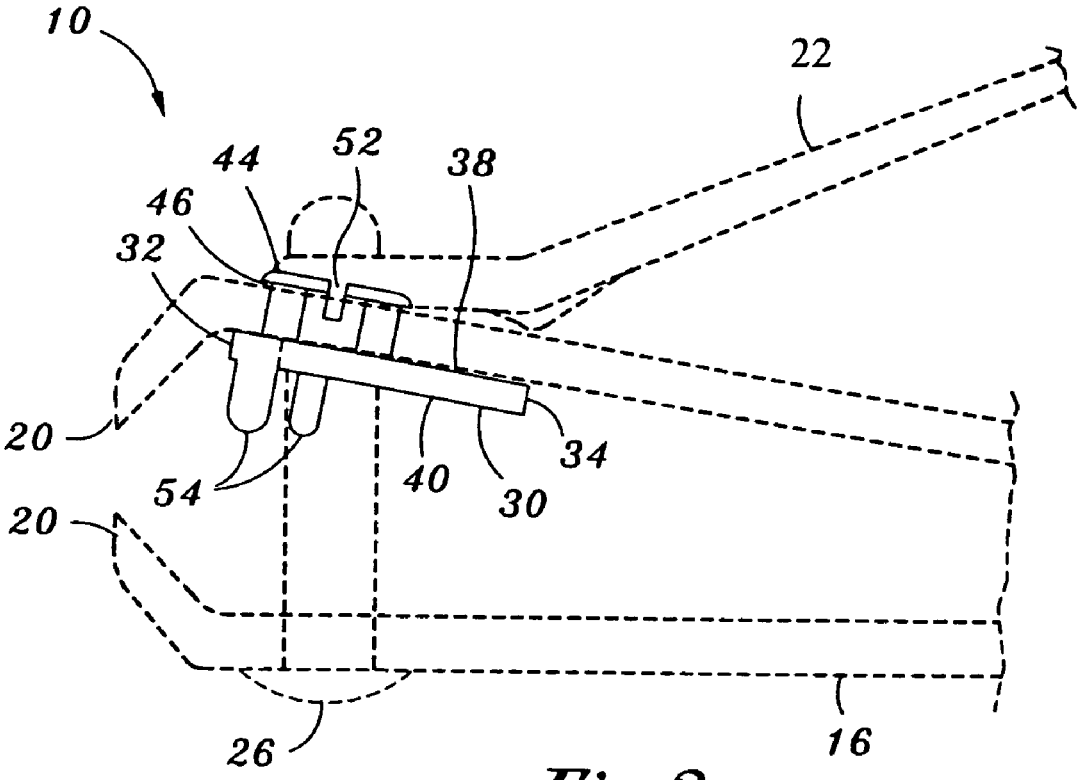
FIG. 3 is a side view of the nail clipper and insert and illustrating the engagement of an annular shoulder of the insert into a hole formed in the upper clipper arm.

Importantly, the insert 28 is disposed between the upper and lower clipper arms 12, 16 and is engaged to the elliptically shaped hole 14 of the upper clipper arm 12, as is shown in FIG. 3. In this regard, the insert 28 is disposed on the side of the upper clipper arm 12 opposite that from which the lever arm 22 is located. Referring to FIG. 2, the insert 28 includes a panel member 30 having opposing upper and lower surfaces 38, 40 which may be generally flat or planar. The panel member 30 may be generally rectangularly or trapezoidally shaped. However, it is contemplated that the panel member 30 may be shaped in a wide variety of configurations including orthogonal or rounded shapes.

As shown in FIG. 2, in the orthogonal or rectangular shape, the panel member 30 may include opposing panel side edges 36, a panel forward edge 32 and a panel aft edge 34. Extending upwardly from the upper surface 38 of the insert 28 is an annular ring or a shoulder 42. The annular shoulder 42 is sized and configured to be complimentary to the elliptically shaped hole 14 for receipt thereinto. Although shown as generally oblong or elliptically shaped, it should be noted that the hole 14 in the upper clipper arm 12 may be provided in any shape including shapes and may have at least one generally straight side. The annular shoulder 42 is configured to provide a means for retaining or connecting the insert 28 to the upper clipper arm 12. The retaining pin 26 extends through a bore 48 formed in the annular shoulder 42 to enable engagement of the groove 56 of retaining pin 26 with the lever arm 22.

Figure 4:
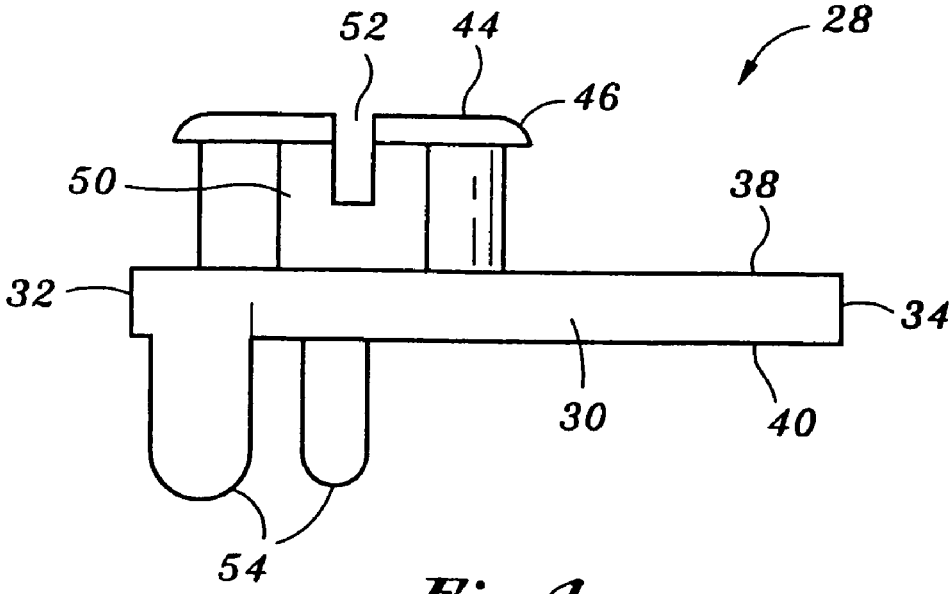
FIG. 4 is a side view of the insert and illustrating a panel member having the annular shoulder extending upwardly therefrom and posts extending downwardly therefrom.

The annular shoulder 42 may include an upper edge 44 having a radially outwardly protruding lip 46 extending therearound. Preferably, the annular shoulder 42 may be configured such that a spacing between the lip 46 and the upper surface 38 is at least equivalent to a thickness of the upper clipper arm 12. In this manner, the insert 28 may be completely engaged to the upper clipper arm 12 through the hole 14 formed therein. To facilitate insertion of the lip 46 through the hole 14 in the upper clipper arm 12, it is also contemplated that the annular shoulder 42 may include two diametrically opposed notches 52 extending axially at least partially from the upper edge 44 of the annular shoulder 42 towards the upper surface 38 of the panel member 30, as is shown in FIGS. 2–4.

The notches 52 may preferably be oriented to respectively face toward the panel side edges 36 of the panel member 30. However, the notches 52 may be oriented in any position and may be provided in any number. Furthermore, it is contemplated that the annular shoulder 42 may include two diametrically opposed flats 50 formed on an exterior of the annular shoulder 42 which may be angularly oriented or aligned coincident with the notches 52. Such flats 50, if included, are preferably formed on an exterior side of the annular shoulder 42 and are preferably configured to be complimentary to the hole 14 in the upper clipper member for improved fitting of the annular shoulder 42 therewithin. More specifically, the flats 50 may provide a means to retain the angular position of the insert 28 relative to the cutting edges 20.

Extending downwardly from the lower surface 40 is at least one post 54. However, two pairs of posts 54 are preferably included. Preferably, the post 54 is located adjacent the forward edge of the panel member 30 and is configured to limit the outward projection of clippings that are generated during trimming of finger nails and toe nails. If the insert 28 includes two pairs of posts 54 extending downwardly from the lower surface 40, the posts 54 of one of the pairs may be positioned on opposite sides of the annular shoulder 42 adjacent respective ones of the panel side edges 36. The posts 54 of the other one of the pairs are preferably positioned adjacent to the panel forward edge 32.

As can be seen in FIGS. 1–4, each one of the posts 54 may have a generally elongated cylindrical shape. The posts 54 of the pair located at the panel forward edge 32 are preferably of a larger diameter than that the posts 54 of the pair that are positioned on opposite sides of the annular shoulder 42. However, it is contemplated that the posts 54 may be configured in a variety of shapes and sizes other than the cylindrical shaped size shown in FIGS. 1–4. Furthermore, it is contemplated that the posts 54 that are disposed adjacent the panel forward edge 32 may be of any size relative to the size of the posts 54 located adjacent the opposing sides of the annular shoulder 42.

As can be seen in FIGS. 1–4, the insert 28 may be configured such that the panel forward edge 32 may have a generally arcuate or slightly curved shape to match a generally arcuate shape of the cutting edges 20 of a conventional configuration of the nail clipper 10. However, the panel forward edge 32 may be configured as a straight line or in any suitable shape or configuration. In addition, it is contemplated that the panel forward edge 32, panel aft edge 34 and panel side edges 36 may each be beveled (not shown) such that the bevels of the panel member 30 are sloped inwardly along a downwardly direction from the upper surface 38 to the lower surface 40 of the panel member 30. It is also contemplated that the panel forward edge 32, panel aft edge 34 and panel side edges 36 may be generally rounded.

In addition, the panel member 30 itself may be shaped such that a corner thereof, defined by an intersection of the panel aft edge 34 with the panel side edges 36, is chamfered at an angle such as at a 45 degree angle. Furthermore, it is contemplated that the insert 28 may be provided in a variety of sizes sufficient to be complimentary to and retrofittable to a nail clipper 10 of any size. For example, a nail clipper 10 that is used for trimming toe nails is typically of a larger size than a nail clipper 10 that is used for trimming finger nails, and vice versa.

In operation the insert 28 may be assembled with the nail clipper 10 by simply extending the retaining pin 26 up from the hole 18 in the lower clipper arm 16 through the insert 28 and passing into the hole 14 of the upper clipper arm 12 and into pivotable engagement with the lever arm 22 via the groove 56 in the retaining pin 26. The annular shoulder 42 of the insert 28 is received by the hole 14 of the upper clipper arm 12 and may be retained thereby due to the engagement of the lip 46 against an outer surface of the upper clipper arm 12. The addition of notches 52 may facilitate slight inward flexion of upper portions of the annular shoulder 42 during insertion of the lip 46 through the hole 14 in the upper clipper arm 12. Flats 50 formed on the exterior of the annular shoulder 42 may provide a means to angularly orient the insert 28 relative to the nail clipper 10 such that the posts 54 of the insert 28 are disposed adjacent the cutting edges 20.

In operating the nail clipper 10, a user moves the lever arm 22 into its operative position such that depression of the lever arm 22 brings the cutting edges 20 of the upper and lower clipper arms 12, 16 into direct engagement with one another. A finger nail or a toe nail may be inserted into the gap between the cutting edges 20 to a desired depth such that depression of the lever arm 22 causes trimming or cutting of the finger nail or toe nail. Upon cutting the finger nail or toe nail, the nail clipping is generated which then is projected against one or both of the posts 54 located adjacent the forward edge of the panel member 30. Upon impingement of the nail clipping against the posts 54, the nail clipping simply falls out of a side of the nail clipper 10 and may be easily disposed of into a waste receptacle or other suitable catch means over which the nail clipper 10 may be held during the nail trimming exercise.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. An improved nail clipper having an upper clipper arm, a lower clipper arm, a lever arm and a retaining pin, the upper and lower clipper arms each having opposing ends with a cutting edge being formed on respective ones of the ends, the upper and lower clipper arms being joined at the ends opposite that on which the cutting edges are formed, the upper and lower clipper arms each including a hole extending therethrough adjacent the cutting edges, the retaining pin extending through the holes and being pivotally engaged to the lever arm in such a manner that depressing the lever arm moves the cutting edges into direct engagement with one another for cutting an article, wherein the improvement comprises:

an insert connected to the upper clipper arm on a side thereof opposite the lever arm, the insert having a panel member with opposing upper and lower surfaces and including an open annular shoulder extending upwardly from the upper surface and at least one post extending downwardly from the lower surface, the annular shoulder being sized and configured to be complementary to the hole in the upper clipper arm for engagement therewithin to connect the insert to the upper clipper arm, the insert being configured such that the post is positioned between the retaining pin and the cutting edge of the upper clipper arm.

2. The nail clipper of claim 1 wherein:

the annular shoulder includes a bore extending through the panel member, the panel member having a generally rectangular shape and including a panel forward edge, a panel aft edge and opposing panel side edges;

the insert including two pairs of posts positioned adjacent the side edges, the posts of one of the pairs being positioned on opposite sides of the annular shoulder, the posts of the other one of the pairs being positioned at opposite corners of the panel member adjacent the panel forward edge.

3. The nail clipper of claim 2 wherein each one of the posts is generally cylindrically shaped, the pair of posts that are positioned adjacent to the panel forward edge being of a larger diameter than that of the pair of posts that are positioned on opposite sides of the annular shoulder.

4. The nail clipper of claim 2 wherein the annular shoulder includes an upper edge having a radially outwardly protruding lip extending therearound.

5. The nail clipper of claim 4 wherein a spacing between the lip and the upper surface is sized to be complementary to a thickness of the upper clipper arm.

6. The nail clipper of claim 4 wherein the annular shoulder includes a pair of diametrically opposed axially oriented notches extending at least partially downwardly from the upper edge toward the upper surface, the notches being positioned adjacent the respective ones of the posts of the pair that are located on opposite sides of the annular shoulder.

7. The nail clipper of claim 6 wherein:

the annular shoulder including a pair of flats formed on an exterior thereof and being positioned in general alignment with the notches;

the hole in the upper clipper arm being shaped complementary to the annular shoulder.

8. The nail clipper of claim 2 wherein the panel forward edge has an arcuate shape.

9. The nail clipper of claim 2 wherein the panel forward edge, the panel aft edge and the panel side edges are beveled.

10. A nail clipper adapted to restrict the outward projection of clippings during cutting of an article, the nail clipper comprising:

an elongate upper clipper arm having opposing ends with a cutting edge formed on one of the ends and including an elliptically shaped hole formed therethrough and being positioned adjacent the cutting edge;

an elongate lower clipper arm having opposing ends with a cutting edge formed one on of the ends and including a circular hole formed therethrough and being positioned adjacent the cutting edge, the upper and lower clipper arms being joined at respective ones of the ends opposite that on which the cutting edges are formed such that the cutting edges are separated by a gap;

an elongate lever arm having opposing ends and being disposed on a side of the upper clipper arm opposite the lower clipper arm;

a retaining pin extending from the circular hole, passing through the elliptically shaped hole and being pivotally engaged to the lever arm in such a manner that depressing the lever arm moves the cutting edges into direct engagement with one another for cutting the article; and an insert disposed on a side of the upper clipper arm opposite the lever arm, the insert including a rectangularly shaped panel member having opposing upper and lower surfaces, the panel member including opposing panel side edges, a panel forward edge and a panel aft edge, the insert including an annular shoulder extending upwardly from the upper surface and two pairs of posts extending downwardly from the lower surface and being located adjacent the side edges, the posts of one of the pairs being positioned on opposite sides of the annular shoulder, the posts of the other one of the pairs being positioned at opposite corners of the panel member adjacent the panel forward edge, the annular shoulder being sized and configured to be complementary to the elliptically shaped hole for receipt thereinto and including a bore to allow passage of the retaining pin, the posts being configured to prevent outward projection of clippings during cutting of the article by the cutting edges.

11. The nail clipper of claim 10 wherein each of the posts are generally cylindrically shaped, the pair of posts that are positioned adjacent to the panel forward edge being of a larger diameter than that of the pair of posts that are positioned on opposite sides of the annular shoulder.

12. The nail clipper of claim 10 wherein the annular shoulder includes an upper edge having a radially outwardly protruding lip extending therearound.

13. The nail clipper of claim 12 wherein the annular shoulder includes a pair of diametrically opposed axially oriented notches extending at least partially downwardly from the upper edge toward the upper surface.

14. The nail clipper of claim 10 wherein the panel forward edge has an arcuate shape.

15. The nail clipper of claim 10 wherein the panel forward edge, the panel aft edge and the panel side edges are beveled.

16. The nail clipper of claim 10 wherein the annular shoulder includes two diametrically opposed flats formed on an exterior side thereof.

17. The nail clipper of claim 12 wherein a spacing between the lip and the upper surface being sized to be complementary to a thickness of the upper clipper arm.

* * * * *